United States Patent [19]

Kubis

[11] 4,108,135

[45] Aug. 22, 1978

[54] ARRANGEMENT FOR EXTERNAL OILING OF CYLINDER LINERS OF INTERNAL COMBUSTION ENGINES

[75] Inventor: Heribert Kubis, Nuremberg, Fed. Rep. of Germany

[73] Assignee: Maschinenfabrik Augsburg-Nürnberg Aktiengesellschaft, Nuremberg, Fed. Rep. of Germany

[21] Appl. No.: 796,884

[22] Filed: May 16, 1977

[30] Foreign Application Priority Data

May 14, 1976 [DE] Fed. Rep. of Germany ..... 2621348

[51] Int. Cl.[2] ..... F01M 1/00

[52] U.S. Cl. ..... 123/196 R; 123/41.84

[58] Field of Search ..... 123/41.83, 41.84, 41.42, 123/196 M, 196 R; 184/6.5

[56] References Cited

U.S. PATENT DOCUMENTS 1,764,739 6/1930 Meyer ..... 123/41.84

FOREIGN PATENT DOCUMENTS 1,019,506 11/1957 Fed. Rep. of Germany ..... 123/41.84

1,220,202 6/1966 Fed. Rep. of Germany ..... 123/41.84

391,386 4/1933 United Kingdom ..... 123/41.84

*Primary Examiner*—Ronald H. Lazarus

*Attorney, Agent, or Firm*—Walter Becker

[57] ABSTRACT

An arrangement for external oiling of cylinder liners of internal combustion engines. The cylinder liners are flanged and are inserted directly into the bores of the cylinder block. An annular chamber is provided in the bores and/or the cylinder liners near the cylinder head. The annular chamber is connected to a feed line for the supply of engine lubricating oil. From the annular chamber, especially in order to prevent fretting corrosion, the engine lubricating oil, uniformly distributed over the circumference and partly in a pulsating fashion, slowly seeps downwardly through the clearance between the bore and the cylinder liner. The lubricating oil then flows into the oil pan. At least one oil drain line is provided to prevent a pressure buildup and is connected with an annular space arranged above the annular chamber toward the cylinder head and as close as possible to the upper end of the cylinder liner between the latter and the bore of the cylinder block; the engine lubricating oil in the annular chamber is at a predetermined pressure.

7 Claims, 2 Drawing Figures

Figure 1:
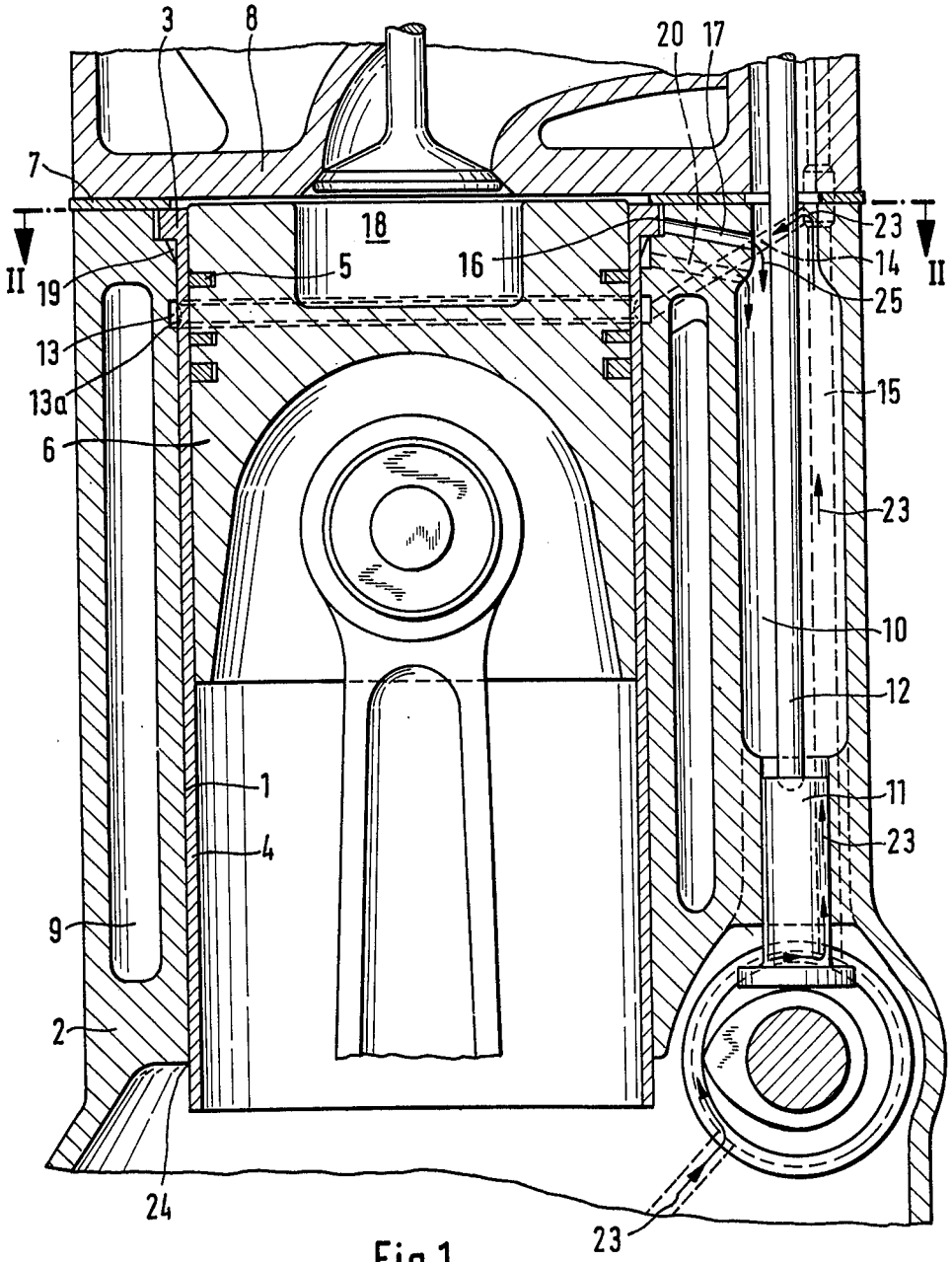

ARRANGEMENT FOR EXTERNAL OILING OF CYLINDER LINERS OF INTERNAL COMBUSTION ENGINES

The present invention relates to an arrangement for external oiling of cylinder liners of internal combustion engines, according to which the cylinder liners are flanged and are inserted directly into the bores of the cylinder block. An annular chamber is provided in the bores and/or the cylinder liners near the cylinder head. The annular chamber is connected to a feed line for the supply of engine lubricating oil. From the annular chamber, especially in order to prevent fretting corrosion, the engine lubricating oil, uniformly distributed over the circumference and partly in a pulsating fashion, slowly seeps downwardly through the clearance between the bore and the cylinder liner. The lubricating oil then flows into the oil pan. At least one oil drain line is provided to prevent a pressure build-up.

An arrangement of this type was disclosed in German Offenlegungsschrift No. 1 955 805 and, without an additional oil drain line, in German Auslegeschrift No. 1 576 407. Above all, these arrangements for the first time permanently avoided the formation of fretting corrosion between the bore or inner wall of the cylinder block and the outer surface of the cylinder liner, so that, even after a long period of service, the cylinder liner is readily removable. Since no more rust or carbonization can develop, the danger of cylinder liners bulging is overcome and the heat transfer between the cylinder liner and the cylinder block is substantially improved.

After some experience with cylinder liners provided with the above described oiling arrangements, it soon became apparent that it is necessary not only to supply the lubricating oil under pressure but also to maintain it at a fixed pressure in the annular chamber in order to obtain a good circulation and a sufficiently quick rate of seeping of the oil through the clearance between the bore and the cylinder liner, so that any impurities are in time also flushed out and do not settle or form deposits. For this reason, the practice of providing an additional oil drain line directly from the annular chamber, as proposed in German Offenlegungsschrift No. 1 955 805, was abandoned.

It also became apparent that the engine lubrication oil, which is under pressure in the annular chamber, not only seeps downwardly but, due to the capillary action in the clearance and "breathing" of the cylinder liner caused by gas pressure stresses and normal piston stresses, also seeps upwardly, i.d., in the direction toward the cylinder head, out of the annular chamber. Even where a very strong seal of the liner flange exists due to great contact pressures and the sealing effect of the cylinder head gasket, it is not possible to prevent part of this upwardly flowing engine lubricating oil from passing outwardly into the cooling water jacket as well as inwardly into the combustion chamber from beneath the rims of the cylinder head gasket due to inevitably existing micro clearances which tend to increase due to the lift-off pulsation of the cylinder head caused by the pressure in the cylinder. As a result of these oil seepages, especially into the combustion chamber, poor emission levels are obtained and carbon deposits from at the outer edge of the piston head, making normal operation of the internal combustion engine difficult or impossible. Finally, the designs according to the prior art have the drawback that, particularly with thin-walled cylinder liners, there may be a danger of failure due to one or more cavities between the liner and the cylinder block in the region of the annular chamber. This, however, is not considered to be of primarily importance at this stage.

This is the starting point of the present invention, an object of which is to avoid the above mentioned drawbacks and to achieve a continuously effective satisfactory external oiling of the entire cylinder liner with an arrangement of the general type previously described, without engine lubricating oil leaking out at the cylinder head end and seeping into the combustion chamber and/or into the cooling water jacket.

It is a further object of the present invention to eliminate the risk of failure of the cylinder liner.

Figure 2:
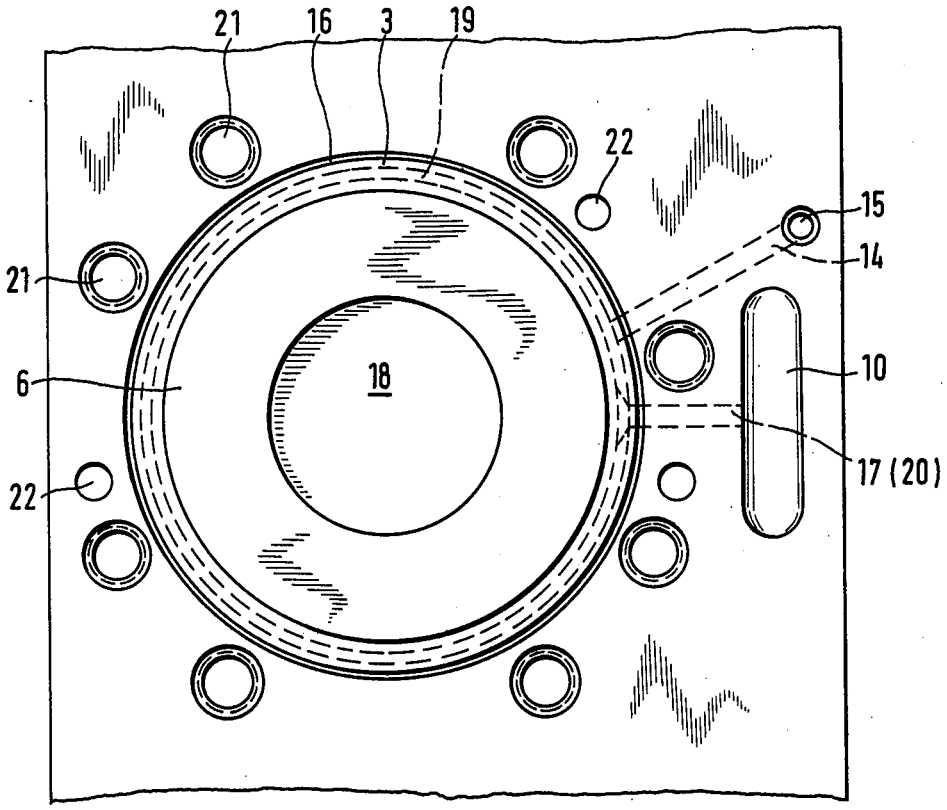

These and other objects and advantages of the present invention will appear more clearly from the following specification in connection with the accompanying drawings, in which:

FIG. 1 is a longitudinal section through the upper part of a cylinder block provided with an arrangement pursuant to the present invention; and FIG. 2 is a section taken along the line II—II of FIG. 1.

The arrangement pursuant to the present invention is characterized primarily in that the oil drain line is connected with an annular space arranged above the annular chamber toward the cylinder head and as close as possible to the upper end of the cylinder liner between the latter and the bore of the cylinder block; the engine lubricating oil in said annular chamber is at a predetermined pressure.

The arrangement of the present invention insures that an adequate pressure can be built up in the annular chamber for distributing the engine lubricating oil around the entire circumference of the cylinder liner. The present arrangement also insures that no oil leaks out between the cylinder head gasket and the liner flange, because the oil collects in the annular space and can readily flow off solely by gravity. The oil drain line must naturally conform to the position of the installed engine block in such a way that it forms a slope, insuring at least a substantial emptying of the annular space.

In order finally to also reduce the risk of the cylinder liner falling, it is a further development of the invention to arrange the annular chamber, which conveys the engine lubricating oil, at such a distance below the bottom face of the cylinder head that the top piston ring, during the expansion stroke of the piston, only passes the position of the annular chamber after the combustion pressure in the combustion chamber has been reduced by at least one quarter to one third of its maximum value. Such a relocation of the annular chamber to a lower position may be effected without difficulty with the arrangement of the present invention because the engine lubricating oil is now pressurized and thus positively effects satisfactory oiling.

The annular space which collects the engine lubricating oil is expediently formed by the gap between the bore of the cylinder block and the flange of the cylinder liner, or by the cavity inevitably formed below the flange of the cylinder liner resulting from the bevelling, of the bore, necessary during manufacture. In special cases, both annular spaces may be used at the same time, in which instance, however, each annular space has its own drain line.

Referring now to the drawings in detail, the arrangement shown in FIG. 1 comprises a cylinder liner 4 which is provided with a flange 3 and is inserted from above into the bore 1 of a cylinder block 2. A piston 6 provided with piston rings 5 and a combustion chamber 18 is movably supported in the cylinder liner 4. The upper end face of the cylinder liner 4 or its flange 3 is flush with the upper face of the cylinder block 2. Both the cylinder block 2 and the flange 3 are at least partially covered by a flat gasket 7 which is pressed firmly against flange 3 by the cylinder head 8 which lies above the gasket 7. The cylinder block 2 is furthermore provided with a cooling-water jacket 9 which encircles the bore 1 and, at the side, with a cavity 10 for the valve tappets 11 and pushrods 12.

When, as illustrated, the piston 6 is in its top dead center position, the annular chamber 13 formed in the bore 1 outside the cylinder liner 4 is below the uppermost piston ring 5. The annular chamber 13, through a feed line 14, communicates with a pressure line 15 which comes from the oil pump and passes through the cylinder block 2 into the cylinder head 8 for lubricating the rocker arms (not shown). If the cylinder liner 4 is relatively thick, the annular chamber 13*a* may also be formed in said liner 4 as shown by the dash lines. Between the flange 3 of the cylinder liner 4 and the bore 1 is a gap or annular space 16 from which an oil drain line 17 extends diagonally downwardly into the cavity 10.

Finally, below the flange 3, there is inevitably a further annular space 19 resulting from the bevelling, of bore 1, which is necessary during manufacture. The annular space 19 is somewhat wider at one spot and, from this spot, by means of a downwardly sloping oil drain line 20 which is shown by dash lines, communicates with the cavity 10. This oil drain line 20 is optional because generally one such line 17 is sufficient.

FIG. 2 shows bores 21 for fastening the cylinder head 8, and bores 22 which lead to the cooling water jacket 9. Furthermore, FIG. 2 shows how the oil drain lines 17, 20 lead to the cavity 10 and how the feed line 14 leads to the pressure line 15 which is located at the side of cavity 10.

The method of operation is as follows:

The oil pump delivers the engine lubricating oil along the arrows 23 through the pressure line 15 and the feed line 14 into the annular chamber 13, where it slowly seeps downwardly at a fixed pressure between the cylinder liner 4 and bore 1. The oil emerges again at the end 24 of bore 1 and flows into the oil pan of the engine. As previously mentioned, the lubricating oil at the same time seeps upwardly along the cylinder liner 4, collects, for example, in the gap 16 which is not pressurized, and then flows through the oil drain line 17 along arrow 25, through the cavity 10, and also back to the oil pan. Consequently, the oil cannot exert a pressure against the flat gasket 7 and leak below said gasket into the combustion chamber 18 or through the holes 22 into the cooling-water jacket 9.

It is, of course, to be understood that the present invention is, by no means, limited to the specific showing of the drawings, but also encompasses any modifications within the scope of the appended claims.

What I claim is:

1. An internal combustion engine which comprises:

a cylinder block having a bore;

a cylinder head arranged above said cylinder block and connected thereto;

a cylinder liner detachably inserted into said bore so as to form at least a minimal clearance between said cylinder liner and said cylinder block, said cylinder liner having a radially outwardly extending flange provided at the cylinder head end of said cylinder liner;

a piston reciprocably mounted in said cylinder liner, and with said cylinder head defining a combustion chamber, at least one piston ring associated with said piston;

annular chamber means provided in at least one of said cylinder block and said cylinder liner and located therebetween, at least one annular space being formed between said cylinder liner and said cylinder block and being located between said annular chamber means and said cylinder head as close as possible to the latter in order to prevent oil pressure build up between the cylinder liner and the cylinder block;

a feed line communicating with said annular chamber means and adapted to supply oil at a predetermined pressure to said annular chamber means; and means permitting escape of said oil from said minimal clearance between said cylinder liner and said cylinder block, whereby said oil flows into said annular chamber, slowly seeps downwardly through the clearance between the bore and the cylinder liner in order to prevent fretting corrosion between the innerwall of the cylinder block and the outer surface of the cylinder liner, and flows out through said escape means.

2. An internal combustion engine according to claim 1, in which said annular chamber means is spaced from the lower edge of said cylinder head by such a distance that said at least one piston ring during the power stroke of said piston passes by said annular chamber means only when the pressure in said combustion chamber has dropped by at least from $\frac{1}{4}$ to $\frac{1}{3}$ of its maximum pressure at the time of ignition.

3. An internal combustion engine according to claim 1, which includes at least one oil drain line to said at least one annular space which depending on the position of the cylinder block is so arranged that said at least one oil drain line has at any rate a drop by means of which said at least one annular space is emptied to at least a major extent.

4. An internal combustion engine according to claim 1, in which said at least one annular space is formed by a gap between said bore of said cylinder block and said flange of the cylinder liner.

5. An internal combustion engine according to claim 1, in which said cylinder block is directly below said flange of said cylinder liner provided with a bevelled portion defining with the adjacent portion of said liner an annular chamber for the oil drainage.

6. An internal combustion engine according to claim 1, in which said annular space comprises two annular chambers between said cylinder liner and said cylinder block for the oil drainage, separate oil drainage lines being respectively provided for said last mentioned annular chambers.

7. An internal combustion engine according to claim 1, which includes valve tappets and pushrods therefore, and in which said cylinder block is provided with passage means for reciprocable movement of said valve tappets and pushrods, oil drainage, said at least one oil drain line leading into said passage means.

* * * * *